United States Patent [19]

Leem

[11] 4,136,980

[45] Jan. 30, 1979

[54] MECHANICAL PENCIL

[76] Inventor: Tae Yoon Leem, 310-92ka, Sungsu-Dong, Sungdong-Ku, Seoul, Rep. of Korea

[21] Appl. No.: 786,857

[22] Filed: Apr. 12, 1977

[51] Int. Cl.[2] ..... B43K 21/08; B43K 27/14

[52] U.S. Cl. ..... 401/31; 401/75

[58] Field of Search ..... 401/75; 401/31

[56] References Cited

U.S. PATENT DOCUMENTS

| | | | |
|---|---|---|---|
| 579,596 | 3/1897 | Mathiesen | 401/75 |
| 1,657,408 | 1/1928 | Platon | 401/75 |
| 2,406,171 | 8/1946 | Smith | 401/75 X |
| 3,250,254 | 5/1966 | Gerspacker | 401/31 |

FOREIGN PATENT DOCUMENTS

| | | | |
|---|---|---|---|
| 573206 | 3/1924 | France | 401/75 |

*Primary Examiner*—Clifford D. Crowder

*Attorney, Agent, or Firm*—Holman & Stern

[57] ABSTRACT

This invention relates to an improved mechanical pencil. More particularly, the invention concerns a mechanical pencil in which the back and forth movements of a writing implement are controlled by a carrier having a spiral guide travelling along the spiral grooves formed on the inside of the pencil barrel, the carrier being adapted to travel along the spiral grooves formed on the inside of the pencil barrel in response to the manual rotations of the cap holding one end of the supporting member.

4 Claims, 9 Drawing Figures a b a b

MECHANICAL PENCIL

BACKGROUND AND SUMMARY OF THE INVENTION

According to the present invention, a writing implement is engaged by a movable carrier. One end of the writing implement is fixed to the carrier/formed such as type type of three-quarters of the round. The carrier controls smoothly the movements of the writing implement when the carrier travels back and forth in response to the rotations of the cap. Because the supporting member of the cap is extended suitably along the inner side of the pencil barrel, it is possible that the circumference of the supporting member of the cap and the carrier makes always the annular member so that, when the cap is rotated, the supporting member induces the rotating force of the carrier. It is noted that the circumference of the carrier is approximately three-quarters of the round while the circumference of the supporting member is approximately a quarter of the round.

For example, when the cap is turned clockwise, the carrier moves forward along the inner spiral grooves of the pencil barrel because the carrier is rotated itself along the spiral grooves in response to the rotations of the cap. If the cap is turned counter-clockwise, the carrier moves back along the spiral grooves of the pencil barrel.

In a preferred form of the invention, the carrier controlled by the cap is engaged in the spiral grooves formed along the inside of the pencil barrel. Since the carrier is linked suitably in the spiral grooves by the spiral guide formed on the carrier, the carrier will move smoothly back and forth under the rotating force of the cap. The movement of the carrier provides a consequent smooth back and forth movement of the writing implement engaged with the carrier.

Because the cap has the protruding holder travelling along the rounded circular recess in the inside of the pencil barrel, the cap can be rotated itself always and also maintain a constant position.

According to the another embodiment of present invention, a double-ended pencil is provided in which a pair of the writing implements are controlled in their back and forth movements by the separate carriers moving along the separate spiral grooves controlled by the separate handles located at the both ends of the pencil barrel.

These and other aspect of the invention will be more fully understood by referring to the following detailed description and the accompanying drawings.

BRIEF DESCRIPTION OF THE DRAWINGS

FIG. 4-*b* shows the cross-sectional view of the cap equipped on the pencil barrel;

FIG. 8*a* shows a perspective view of an alternate embodiment that the protruding holder is replaced with the rounded annular holder;

FIG. 8-*b* shows the cross-sectional view of the alternate embodiment of the FIG. 8-*a.

DESCRIPTION OF THE PREFERRED EMBODIMENTS

Figure 1:
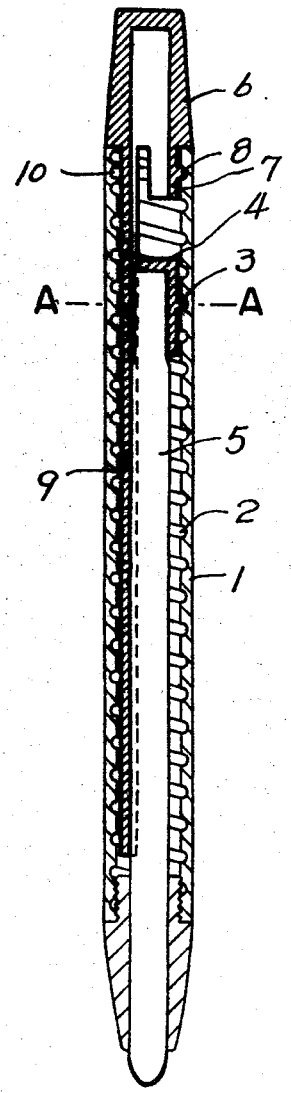
FIG. 1 shows a cross-sectional view of the mechanical pencil of this invention.
Figure 2:
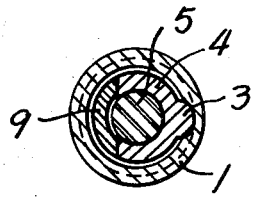
FIG. 2 shows the cross-sectional elevation view of the pencil taken on line A—A of the FIG. 1.

A pencil barrel 1 has spiral grooves 2 interiorly bounded by an inner wall along which a carrier 4 controlled by the rotations of a cap 6 travels. A rounded circular recess 10 is formed in the upper interior area of the inner wall of the pencil barrel 1. The cap 6 of the pencil body includes a protruding holder 8 that engages the recess 10 and a supporting member 9 positioned in the inside of the pencil barrel 1 to touch the carrier 4 so that, when the cap 6 is rotated, the supporting member 9 of the cap 6 induces the rotation of the carrier 4 along the spiral grooves 2 extended down inside of the pencil barrel 1. The carrier 4 of the writing implement 5 is thus caused to undergo back and forth movements by the rotation of the cap 6. The top of the writing implement 5 is supported by the carrier 4.

According to the present invention, the circumference of the carrier 4 is larger than the half circle, conveniently three-quarters of the circumference, the circumference of the supporting member 9 connected with the cap 6 being smaller than the half circle, conveniently a quarter of the circumference, so that the total of the circumferences between the carrier 4 and the supporting member 9 forms an annular member. However, in order to induce the rotation of the carrier 4 along the inside of the pencil barrel 1, the supporting member 9 of the cap 6 is positioned a suitable length therewith so that the carrier 4 can rotate along the spiral grooves 2 to control the back and forth movements thereof. As mentioned above, since the total circumference of the carrier 4 and the supporting member 9 forms an annular member, when the cap 6 is rotated, the supporting member 9 induces the rotations of the carrier 4 along the spiral grooves 2.

The rotation of the cap 6 induces smoothly the back and forth movement of the carrier 4, because the rotation of the cap 6 provides the force to move up and down the carrier 4 along the spiral grooves 2.

For example, when the cap 6 is rotated, the supporting member 9 induces the rotation of the carrier 4 along the spiral grooves 2 because the supporting member 9 is fixed to the cap 6. In other words, it is natural that, due to the rotating force of the supporting member 9 induced from the cap 6, the carrier 4 has to rotate itself along the spiral grooves 2 together with the supporting member 9. Accordingly, when the cap 6 is rotated in a clockwise direction, the carrier 4 is forced to rotate due to the movement by the supporting member 9. On the other hand, when the cap 6 is rotated in a counterclockwise direction the supporting member 9 of the cap 2 gives the carrier the force to rotate itself in the opposite direction. Therefore, it is possible that the writing implement 5 can undergo movement in both directions along the length of the pencil.

Figure 3:
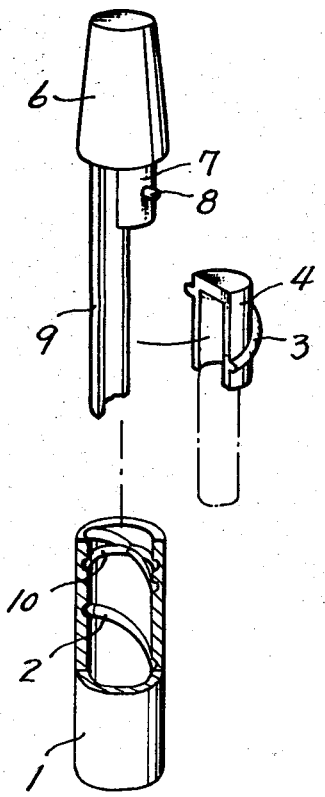
FIG. 3 shows an exploded perspective view of the cap showing how the carrier is connected with the cap and is initially engaged with the spiral grooves of the pencil barrel.

As can be seen from FIG. 3, since the cap 6 has the protruding holder 8 that travels along the rounded circular recess 10 of the pencil barrel 1, the cap 6 can be clinched with the pencil barrel 1 during the rotations.

The carrier 4 has a spiral guide 3 which travels along the spiral grooves 2 of the pencil barrel 1. Since the mutual connection of the carrier 4 which has the large ratio of the circumference of the round and the supporting member 9 which has the small ratio of the circumference of the round form an annular member carrying the writing implement 5 when the cap 6 is rotated, the rotating force acts on the supporting member 9 and the supporting member 9 induces the rotation of the carrier 4 along the spiral grooves 2. Accordingly, the carrier 4 is rotated along the spiral grooves 2 and also controls the up and down movement of the writing implement 5.

Figure 4:
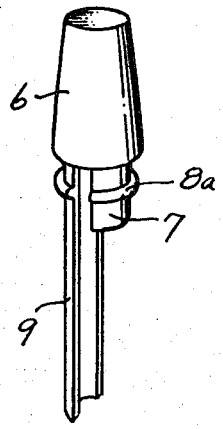
FIG. 4-*a* shows a perspective view of another cap having the rounded annular holder, instead of the protruding holer shown in the FIG. 3.
Figure 4:
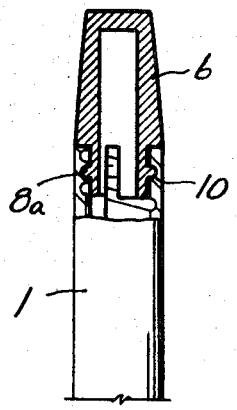

According to the present invention, it is possible to alter the protruding holder 8 to another embodiment shown on the FIG. 4-*a* in which the protruding holder 8 in the FIG. 3 is replaced with the rounded annular holder 8*a*.

Figure 5:
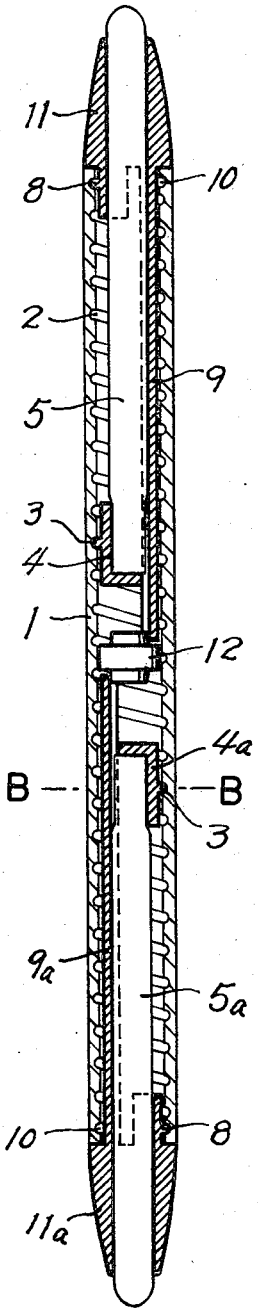
FIG. 5 shows the cross-sectional elevation view of an alternate embodiment of the mechanical pencil of this invention in which a separate writing implement is operative at each end of the pencil barrel.
Figure 6:
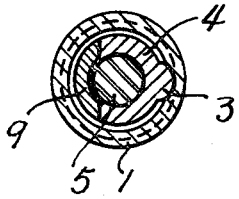
FIG. 6 shows the cross-sectional elevation view of the pencil taken on line B—B of the FIG. 5.

As shown in the FIG. 5, this invention also encompasses another embodiment of the mechanical pencil comprising simultaneously two pencil implements 5, 5*a* in the opposite ends of the pencil barrel 1. In such case the handle 11, 11*a* for adjusting the back and forth movement for each of the writing implements 5, 5*a* is located in each of the heads of the pencil, while each of the carriers 4, 4*a* is located in each of the divided barrels. Of course, by the rotation of the head 11, 11*a* relative to either barrel, both writing implements can be selectively used for writing. According to the embodiment, the inner part of the pencil barrel 1 is separated into two portions by the neutral border member 12 and the structure of each pencil barrel is essentially the same as that of the FIG. 1, except the fact that the up and down movements of the carrier 4, 4*a* are operated by the rotations of each of the heads 11, 11*a* of the pencil because the protruding holder 8 for controlling its own carrier 4, 4*a* is disposed on the head 11, 11*a* of the pencil. As shown, the heads each have an axial bore through which the pencil implements pass.

Figure 7:
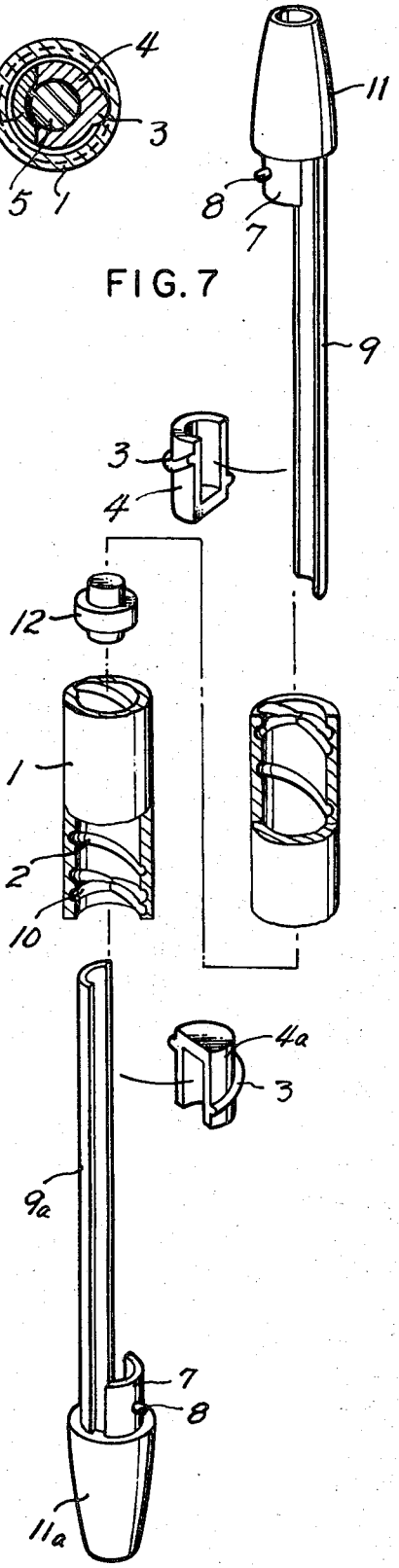
FIG. 7 shows the exploded perspective view of the mechanical pencil in the FIG. 5 showing how the protruding holder is initially engaged with the spiral grooves of the pencil barrel and the carrier is operated.
Figure 8:
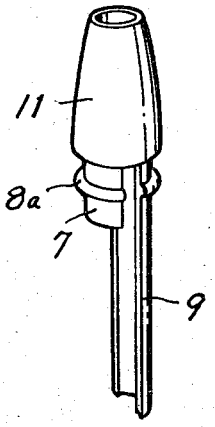
Figure 8:
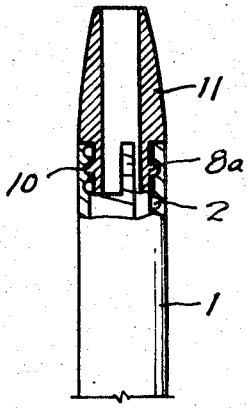

According to the present invention, it is also possible to alter the protruding holder 8 to another embodiment shown on the FIG. 8-*a*, in which the protruding holder in the FIG. 7 is replaced with the rounded annular holder 8*a* in the FIG. 8-*a*.

Figure 9:
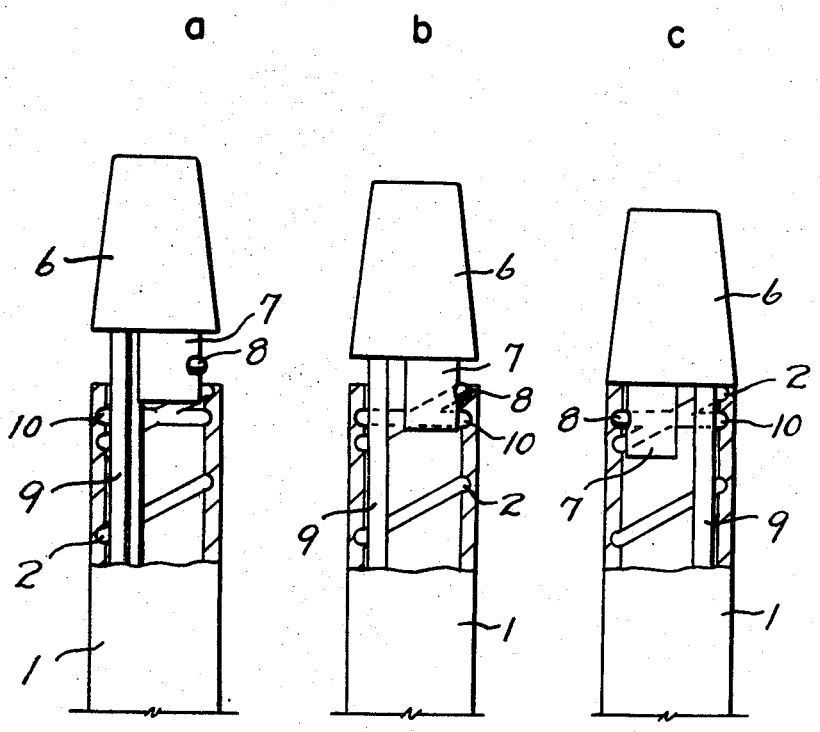
* and FIG. 9-*a, b* and *c* show each of the cross-sectional views showing the steps how the cap of this mechanical pencil is inserted into or pulled out from the rounded circular recess.

As seen from the FIGS. 9-*a*, *b* and *c*, the cap having the protruding holder or the rounded annular holder can be easily inserted into or pulled out from the rounded circular recess through the spiral grooves formed in the inner part of the pencil barrel because the spiral grooves are formed from the end of the pencil barrel so that, through the spiral grooves, it is possible to insert or pull out the protruding holder or the rounded annular holder of the cap into or from the rounded circular recess of the pencil barrel.

As mentioned above, this invention has the advantages that its construction and operation are very simple, and the structure can be produced economically at a relatively low cost.

What is claimed is:

1. A mechanical pencil for adjusting the back and forth movements of a writing implement comprising: a pencil barrel having an inner wall surface in which spiral grooves are formed; a hollow part-annular carrier having a spiral guide that travels along the spiral grooves; and a cap having a protruding holder member which travels through a rounded circular recess formed in the upper part of the inner wall surface of the pencil barrel so that manual rotation of the cap will adjust the rotation of the carrier along the spiral groove in order to cause the writing implement to move in response to the carrier in a back and forth movement, the spiral guide moving in response to the rotation of the cap, the cap having a part-annular supporting member contacting the carrier to define therewith a hollow annular member with said carrier and said supporting member each partly surrounding the writing implement.

2. A mechanical pencil according to claim 1 wherein the said pencil barrel is separated into two portions by providing a neutral border member on the central part of the pencil barrel to omprise a double-ended writing implement, the back and forth movements of each of the writing implements being controlled by separate carriers moving along each of the spiral grooves, each of the carriers being controlled by one of two heads each having a supporting member extending suitably along the inside of each barrel portion to touch the carrier to form an annular member surrounding the writing implement, the protruding holder travelling through the rounded circular recess so that manual rotations of the head will adjust the rotation of the carrier along the spiral grooves so the writing implement will move in response to the carrier in a back and forth movement, each head having an axial bore for passage of the respective writing implements.

3. A mechanical pencil according to claim 1 wherein the protruding holder of the cap is a rounded annular member.

4. A mechanical pencil according to claim 1 wherein the circumference of the carrier is three-quarters of the annular member and the circumference of the supporting member of the cap is a quarter of the annular member.

* * * * *